United States Patent [19]

Watanabe et al.

[11] Patent Number: 5,038,961

[45] Date of Patent: Aug. 13, 1991

[54] TRAYS FOR HOLDING A FOREST OF BOTTLES AND STACKING THE SAME IN LAYERS

[75] Inventors: Makoto Watanabe, Tokyo; Takeyasu Murakami; Yasuzi Kobayashi, both of Shizuoka, all of Japan

[73] Assignee: Yazaki Industrial Chemical Co., Ltd., Shizuoka, Japan

[21] Appl. No.: 493,783

[22] Filed: Mar. 15, 1990

[30] Foreign Application Priority Data

Sep. 11, 1989 [JP] Japan ..... 1-106571[U]

[51] Int. Cl.[5] ..... B65D 75/00

[52] U.S. Cl. ..... 220/519; 220/516; 206/203; 206/427; 206/503; 206/518; 206/821

[58] Field of Search ..... 206/203, 427, 503, 515, 206/518, 520, 562, 563, 821; 220/512, 516, 519

[56] References Cited

U.S. PATENT DOCUMENTS

| | | | |
|---|---|---|---|
| 3,363,802 | 1/1968 | Corneluis | 206/203 |
| 4,667,823 | 5/1987 | Wolfe, Jr. et al. | 206/503 |
| 4,700,836 | 10/1987 | Hammett | 206/503 |
| 4,700,837 | 10/1987 | Hammett | 206/427 |
| 4,846,365 | 7/1989 | Steinlein | 206/203 |
| 4,848,573 | 7/1989 | Salacuse | 206/821 |
| 4,899,874 | 2/1990 | Apps et al. | 206/203 |

FOREIGN PATENT DOCUMENTS

| | | | |
|---|---|---|---|
| 99827 | 2/1984 | European Pat. Off. | 206/821 |
| 306074 | 3/1989 | European Pat. Off. | 206/203 |
| 62-63075 | 10/1988 | Japan . | |
| 62-48913 | 11/1988 | Japan . | |

*Primary Examiner*—David T. Fidei
*Attorney, Agent, or Firm*—Ronald P. Kananen

[57] ABSTRACT

A tray according to the present invention comprises a plastic body having upper and lower surfaces. A number of bottom sockets are distributively formed in the upper surface of the body so the respective bottom portions of bottles can be inserted individually in the bottom sockets. Each bottom socket has a configuration which is obtained by connecting those portions of the respective cross-sectional contours of the bottom portions of two or more different types of bottles which are situated outermost when the individual contours are superposed concentrically so that at least two diametrically facing regions of the one contour are not situated inside the other contour. Cap socket corresponding one of the bottom sockets is defined on the lower surface of the body. Each cap socket is a hole, such as a stepped hole, which has at least two hole portions with different inside diameters.

11 Claims, 4 Drawing Sheets

TRAYS FOR HOLDING A FOREST OF BOTTLES AND STACKING THE SAME IN LAYERS

BACKGROUND OF THE INVENTION

1. Field of the Invention

The present invention relates to trays for holding a forest of bottles filled with a fruit juice drink, coffee, sports drink, black tea, green tea, oolong, and so forth. More particularly, this invention relates to trays adapted to be used in a manner such that one tray is put on a forest of bottles held on another tray, whereby the bottles can be stacked in layers.

2. Description of the Related Art

The trays of this type or the so-called bottle trays are disclosed, for example, in Published Unexamined Japanese Utility Model Application Nos. 62-48913 and 62-63075. Each of these conventional bottle trays has a number of recesses arranged in the form of a matrix on the upper surface thereof. Each of the recesses constitutes a bottom socket in which the bottom portion of a bottle is to be inserted. Also, a number of recesses are arranged on the lower surface of the bottle tray in the same manner as the bottom sockets, that is, so as to be coaxial with their corresponding bottom sockets. Each of these cap sockets, which is smaller than each bottom socket, constitutes a cap socket in which a cap fitted on each bottle is to be inserted.

Thus, if the bottle tray is placed with its bottom sockets upward, a number of bottles can be held standing together on the tray in a manner such that the respective bottom portions of the bottles are fitted individually in the bottom sockets. If all of the trademarks pasted or printed on the peripheral surfaces of the outermost bottles are exposed to the outside, consumers can easily identify the contents of the bottles through visual observation of the trademarks. Thus, the bottles on the bottle tray can be utilized as articles on display in a store. The exhibitive effect of these bottles is greater than the effect produced when a number of bottles are contained in a bottle case for display.

If another bottle tray is put on the forest of bottles so that caps on the individual bottles standing upright on one bottle tray are inserted in their corresponding cap sockets of the another tray, another forest of bottles can be held on the another tray. Thus, by using these bottle trays, a plurality of forests of bottles can be stacked in layers. When the bottles are stacked in this manner, the bottom portion of one of the bottles is fitted in its corresponding bottom socket of a bottle tray, and the top or cap portion of the bottle is fitted in its corresponding cap socket of another bottle tray which directly overlies the forest of the bottles on one tray. Thus, the forest of bottles on each level are held between each two bottle trays, so that the bottles can be securely prevented from sliding horizontally. As a result, the bottles can be stacked in layers with reliability. If the multilayer stacking of the bottles can be effected with stability in this manner, spaces for the storage of the bottles in stores or warehouses or in transportation means can be reduced.

In general, the contours of the bottles of this type vary considerably for each of discrimination, despite the equality in capacity. In other words, the contours of the bottles depend on the unique designs of products which are intended to heighten the consumers' desire to buy the products. Even though the bottles of this type have the same capacity, therefore, their respective bottom portions are naturally different in cross-sectional configuration, due to the variation in contours. The cross section of the bottom portions may, for example, be circular, elliptic, square, or polygonal.

However, each bottom socket of the bottle trays disclosed in the aforementioned applications has a configuration which agrees with the cross-sectional configuration of the bottom portion of a specific bottle to be inserted into the bottom socket. Thus, the bottom socket has a simple configuration selected among circular, elliptic, square, and polygonal configurations. If the configuration of the bottom socket of the conventional bottle trays is different from the cross-sectional configuration of the bottom portion of a bottle, therefore, the bottom portion cannot be inserted into the bottom socket. Accordingly, in the conventional case, it is necessary to provide various bottle trays whose bottom sockets are different in configuration, depending on the difference in cross-sectional configuration between the respective bottom portions of the various bottles.

In many cases, moreover, the mouth portions of these bottles or the caps thereon are different in outside diameter, due to the aforesaid variation in contours. In the conventional arrangement, therefore, various bottle trays whose cap sockets have different diameters must be provided also depending the difference in outside diameter between the caps on the various bottles.

In these circumstances, the conventional bottle trays are exclusive-use trays which are applicable only to a specific type of bottles.

SUMMARY OF THE INVENTION

The object of the present invention is to provide trays which can be applied to bottles of different types, and can not only securely hold a forest of bottles, but also enable these bottles to be stably stacked in layers.

The above object is achieved by a tray according to the present invention, which comprises a body having upper and lower surfaces in use; means for distributively defining, in the upper surface of the body, a number of bottom sockets in which the respective bottom portions of bottles are to be inserted, each of the bottom sockets having an inner peripheral configuration obtained by connecting those portions of the respective cross-sectional contours of the bottom portions of two or more different types of bottles which are situated outermost when the individual contours are superposed concentrically so that at least two diametrically facing regions of the one contour are not situated inside the other contour; and means for distributively defining, in the lower surface of the body, cap sockets in which caps of the bottles are to be inserted, the cap sockets being as many as the bottom sockets and each located coaxially with the bottom socket corresponding thereto.

According to the tray described above, the bottom portion of each bottle can be inserted into the bottom socket when the bottle is situated in a predetermined angular position corresponding to the cross-sectional configuration of the bottom portion of the bottle, with respect to the bottom socket. When the bottom portion of the bottle is inserted into the bottom socket in this manner, the outer peripheral surface of the bottom portion, despite the cross-sectional configuration thereof, comes into contact with at least two regions of the inner peripheral surface of the bottom socket, which has the aforesaid configuration. In other words, the bottom portion of the bottle is held between at least wo regions of the inner peripheral surface of the bottom socket, so that the bottle can stably stand upright. When the respective bottom portions of the bottles of the same type are inserted individually into all the first sockets of the tray, therefore, the bottles are held standing together on the tray. Thus, the tray of the present invention can be applied to at least two types of bottles, depending on the aforementioned configuration of each bottom socket.

Preferably, the tray of the present invention further comprises means for defining the cap sockets as stepped holes each having a plurality of inside diameters, corresponding to at least two types of caps with different outside diameters. In this case, each cap socket is a stepped hole whose diameter is reduced in stages with distance from the open end of the cap socket. Thus, if each of the bottom and cap sockets is provided with the above-mentioned means, the tray of the present invention can be applied to those bottles which are different in the outisde diameter of the caps thereon, as well as in the contour of their bottom portions. More specifically, if another tray is put on the bottles held standing together on the first tray so that the cap on each bottle is fitted in part of one of the cap sockets of the second tray, all the bottles are held between the top- and bottom-side trays. Thus, the bottles can be stably secured without sliding horizontally. Thereafter, another forest of bottles may be put on the second or top-side tray, and still another or third tray may be put on these bottles so that the bottles are held between the second pair of trays. In this manner, a plurality of forests of bottles can be stacked in layers.

The above and other objects, features, and advantages of the invention will be more apparent from the ensuing detailed description taken in connection with the accompanying drawings.

DETAILED DESCRIPTION OF THE PREFERRED EMBODIMENTS

Figure 1:
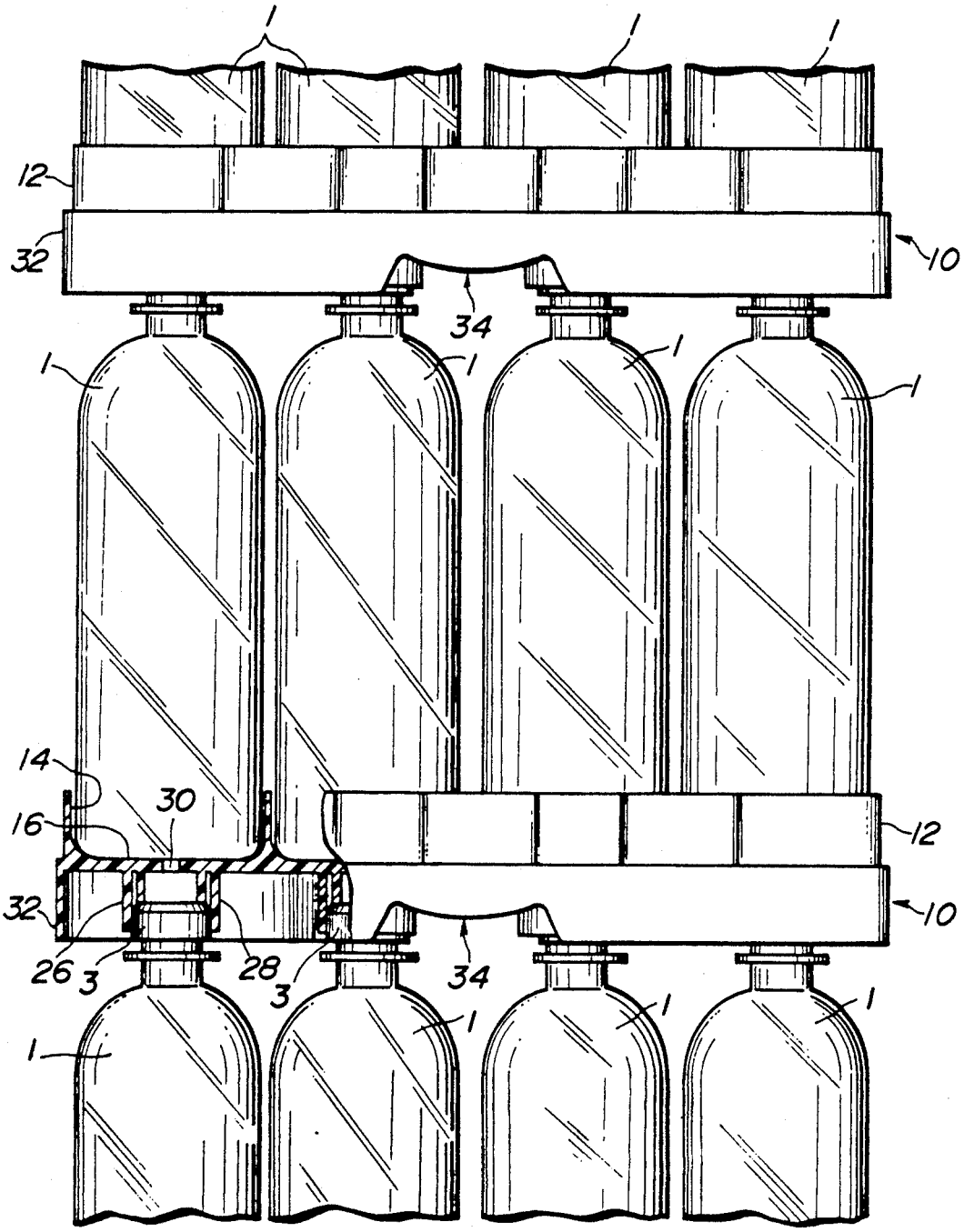
FIG. 1 is a front view, partially in section, showing a state in which bottles are stacked in layers by means of trays according to a first embodiment of the present invention.

Referring now to FIG. 1, so-called bottle trays 10 are arranged vertically spaced with a number of bottles 1 between them. The bottles 1 are products that are filled with a fruit juice drink, coffee, sports drink, black tea, green tea, oolong, and so forth. The mouth of each bottle is closed by means of a cap 3.

Figure 2:
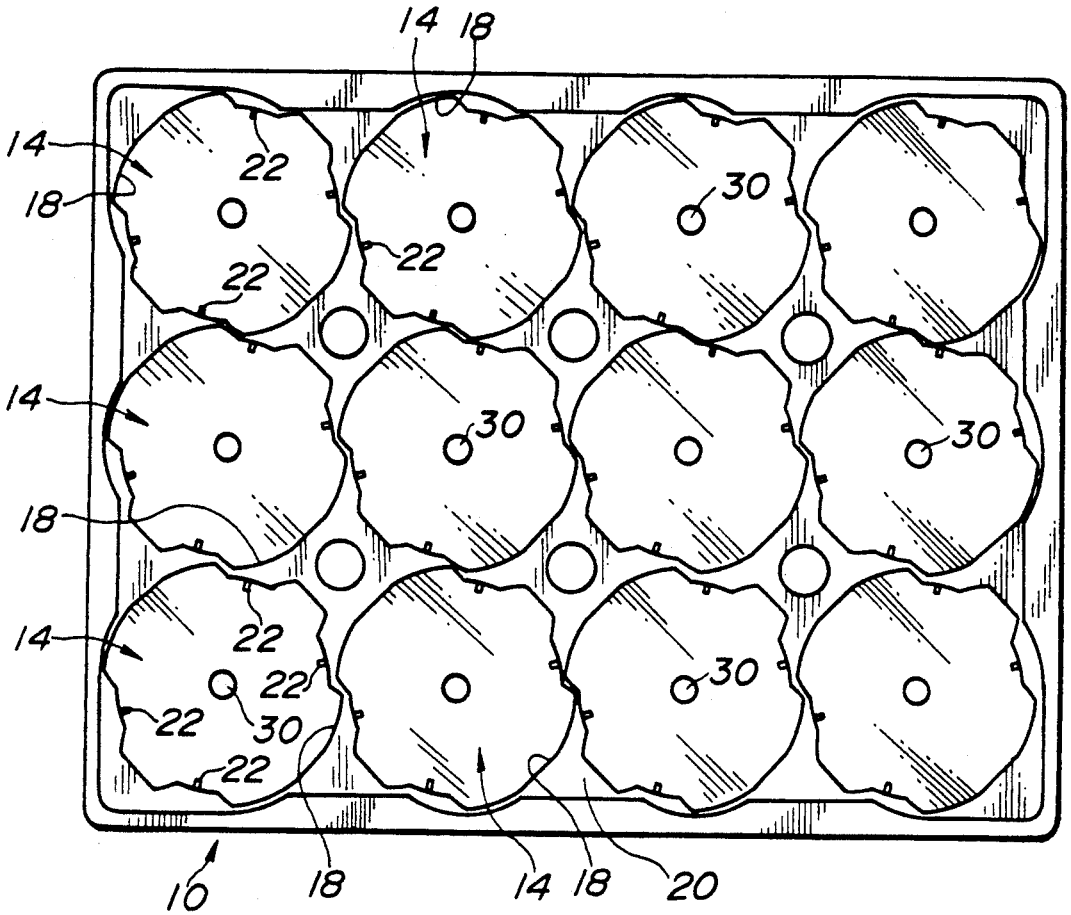
FIG. 2 is a plan view of the tray shown in FIG. 1.
Figure 3:
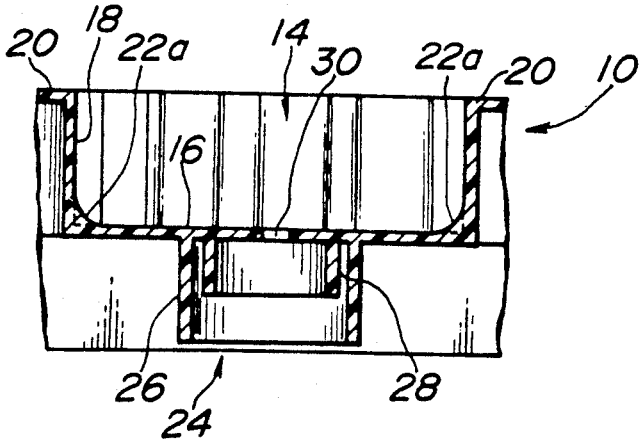
FIG. 3 is a sectional view showing part of the tray shown in FIG. 1.

Each bottle tray 10, as a whole, is a plastic product formed by injection molding. As seen from FIG. 2, the bottle tray 10 has a rectangular body 12. A number of bottom sockets 14 are formed on one side or the upper surface (FIG. 1) of the body 12. The sockets 14 are arranged in the form of a matrix composed of three rows and four columns. Thus, the sockets 14 are twelve in number. As shown in FIG. 3, each bottom socket 14 is defined by a bottom wall 16, constituting part of the body 12, and a peripheral wall 18 integrally rising from the bottom wall 16. The upper peripheral edge of the peripheral wall 18, defining each bottom socket 14, is integrally connected to those of the adjacent sockets by means of a top wall 20 of the body 12. For example, the depth of each bottom socket 14 is set to about 40 mm.

Figure 4:
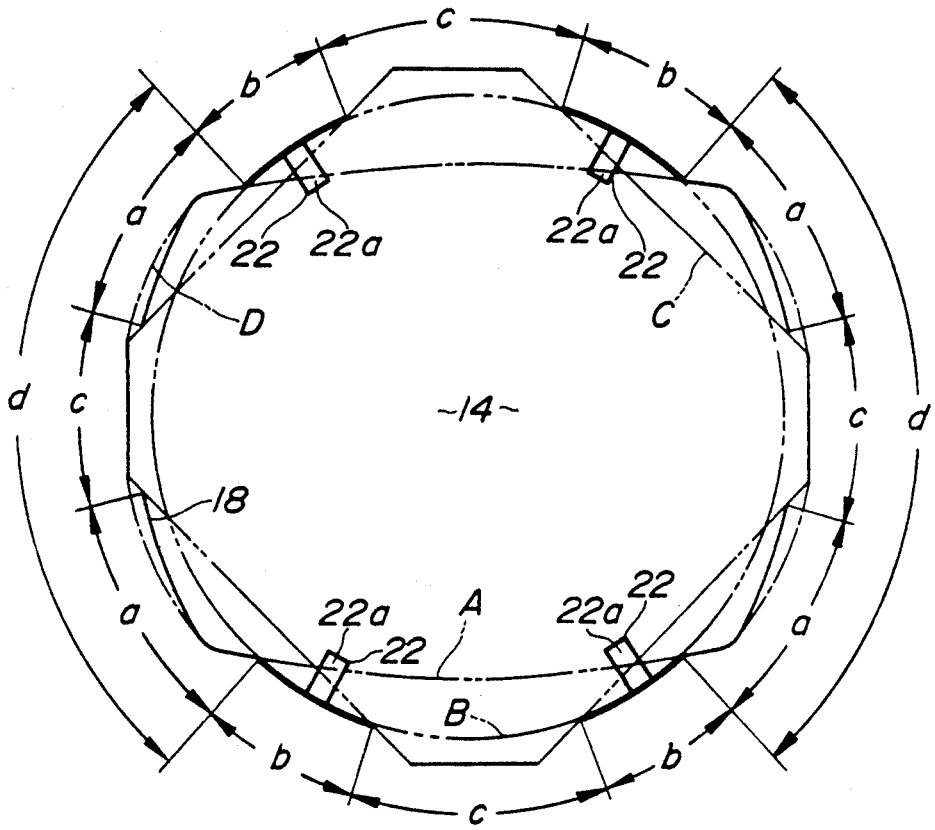
FIG. 4 is a plan view showing the configuration of a bottom socket of the tray shown in FIG. 1.

In this embodiment, the bottom sockets 14 can receive three kinds of bottles whose bottom portions have different circumferential contours. Referring to FIG. 4, there are shown the details of the configuration of the peripheral wall 18 of the bottom socket 14. This contour is obtained by connecting the outermost portions of the respective contours of an ellipse A, a circle B, and a square C superposed concentrically, as indicated individually by two-dot chain lines. In this case, the major and minor axes of the ellipse A are longer and shorter, respectively, than the diameter of the circle B. If the ellipse A is superposed concentrically on the circle B, therefore, those portions of the contour of the ellipse A which are situated corresponding to the opposite ends of the major axis project outward from the contour of the circle B. Also, each diagonal of the square C is longer than the major axis of the ellipse A. If the square C is superposed concentrically on the circle B and the ellipse A so that one of the diagonals of the square C is in line with the major axis of the ellipse A, the four corner portions of the square C project from the contours of the circle B and the ellipse A.

As is evident from the above description with reference to FIG. 4, four portions a of the contour of the ellipse A project outward from the contours of the circle B and the square C, four portions c of the contour of the square C project outward from the contours of the circle B and the ellipse A, and four portions b of the contour of the circle B project outward from the contours of the ellipse A and the square C. Thus, the configuration of the peripheral wall 18 of the bottom socket 14 is obtained by connecting the portions a, b, and c of the individual contours. In this embodiment, the ellipse A and the square C are not perfect in shape. Virtually, the ellipse A is in the form of a rectangle having arcuate sides, and the square C has its four corners chamfered in a manner.

Four guide ribs 22 are integrally formed on the peripheral edge of the bottom wall 16 of each bottom socket 14 so as to be situated corresponding individually to the portions b of the circle B. As shown in FIGS. 3 and 4, each guide rib 22 is in the form of a triangle declining from the peripheral wall 18 to the bottom wall 16. A slanting surface 22*a* of the guide rib 22, extending from the peripheral wall 18, has a length such that the rib 22 intersects both of the respective contours of the ellipse A, and the square C, as shown in FIG. 4.

Figure 5:
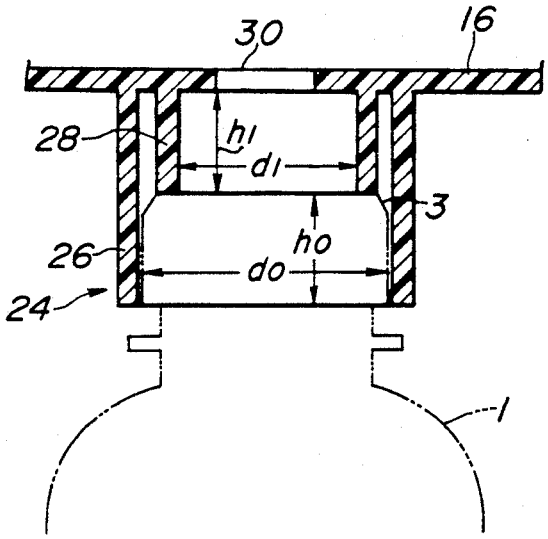
FIGS. 5 and 6 are sectional views showing different ways of using a cap socket of the tray shown in FIG. 1.
Figure 6:
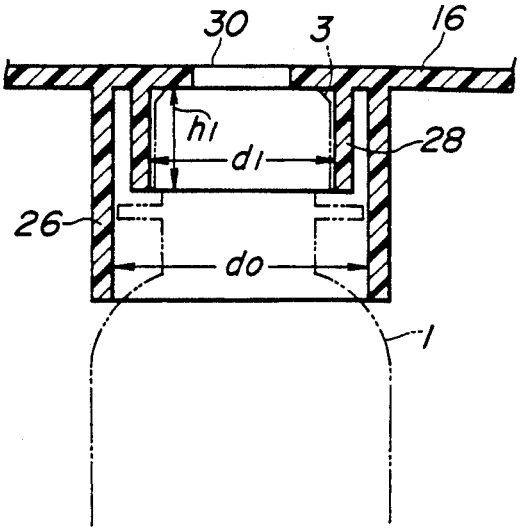

Cap sockets 24, as many in number as the bottom sockets 14, are formed on the other side or the lower surface of the body 12. Each cap socket 24 is located coaxially with its corresponding bottom socket 14. In this embodiment, each cap socket 24 is defined by a circular outer peripheral wall 26 integrally protruding from the bottom wall 16 of the bottom socket 14, and an inner peripheral wall 28 integrally protruding from the bottom wall 16 and situated coaxially inside the outer peripheral wall 26 in a spaced manner. The inner peripheral wall 28 is shorter than the outer peripheral wall 26, so that the cap socket 24 is substantially a stepped hole. Each bottom socket 14 and its corresponding cap socket 24 connect with each other by means of a hole 30 in the bottom wall 16. The respective inside diameters of the outer and inner peripheral walls 26 and 28 are set depending on the outside diameters of the caps 3 on different bottles 1 to which the bottle tray 10 of the present invention is applicable, respectively. As shown in FIGS. 5 and 6, for instance, the inside diameter d0 and height h0 of the outer peripheral wall 26 may be set to 40 mm and 42 mm, respectively, while the inside diameter d1 and height h1 of the inner peripheral wall 28 may be set to 30 mm and 20 mm, respectively.

As seen from FIG. 1, a skirt portion 32 is integrally formed on the body 12 of each bottle tray 10 so as to surround the array of the cap sockets 24. The height of the skirt portion 32 is a little greater than that of the outer peripheral wall 26 of the cap socket 24. Formed on the lower edge of the skirt portion 32 is a notch 34 in which a user's fingers are to be inserted for conveyance.

According to the bottle tray 10 of the first embodiment described above, a number of bottles 1 can be set upright thereon by inserting the respective bottom portions of the bottles 1 individually into the bottom sockets 14 of the tray 10.

Unless the cross-sectional configuration of the bottom portion of each bottle 1 resembles the circle B, that is, if it resembles the ellipse A or the square C, the bottom portion can be inserted into one of the bottom sockets 14 by properly adjusting the rotational angle of the bottle 1 around its axis to the configuration of the bottom socket 14.

In the bottle tray 10 of the present invention, the configuration of each bottom socket 14 is not completely coincident with the cross-sectional configuration of the bottom portion of each bottle 1. When the bottom portion of the bottle 1 is inserted into the bottom socket 14, however, the peripheral surface of the bottom portion comes into contact with four regions of the peripheral wall 18 of the bottom socket 14, which has the configuration shown in FIG. 4, despite the cross-sectional configuration of the bottom portion. Thus, the bottle 1 can be stably kept upright.

Further, a number of bottles 1 can be held between the two bottle trays 10 by putting the second tray 10 onto the forest of bottles 1 on the first tray 10. In doing this, the caps 3 on the individual bottles 1 are inserted into their corresponding cap sockets 24 of the top-side tray 10 so that they abut against a ring-shaped end face of the inner peripheral wall 28, inside the outer peripheral wall 26. Thus, the bottles 1 can be prevented from sliding horizontally. Even though the bottom portions of the bottles 1 fitted in the bottom sockets of the bottom-side bottle tray 10 are subject to some variation in size, moreover, the axis of each bottle 1 can be accurately aligned with that of its corresponding bottom socket 14, that is, the axis of its corresponding cap socket 24 of the top-side bottle tray 10, since the bottom of each bottle 1 is guided by the slanting surfaces 22*a* of the guide ribs 22 of the bottom socket 14. Accordingly, the cap sockets 24 of the second bottle tray 10 can be center-aligned with the caps 3 on their corresponding bottles 1 by only putting the second tray 10 onto the bottles 1 on the first tray 10. Thus, the second tray 10 can be easily set on the bottles 1.

After new bottles 1 are inserted individually into the bottom sockets 14 of the top-side bottle tray 10, still another bottle tray 10 is put on these bottles 1. By repeating these steps of procedure, a plurality of forests of bottles 1 can be stacked in layers, as shown in FIG. 1.

In the first embodiment described above, the cap 3 on each bottle 1 is inserted in the space inside the outer peripheral wall 26 of its corresponding cap socket 24. If the cap 3 has a relatively small outside diameter, however, it may alternatively be inserted in the space inside the inner peripheral wall 28 of the cap socket 24, as shown in FIG. 6. In this case, the cap 3 is forced into the socket 24 so that it abuts it abuts against the bottom wall 16.

Figure 7:
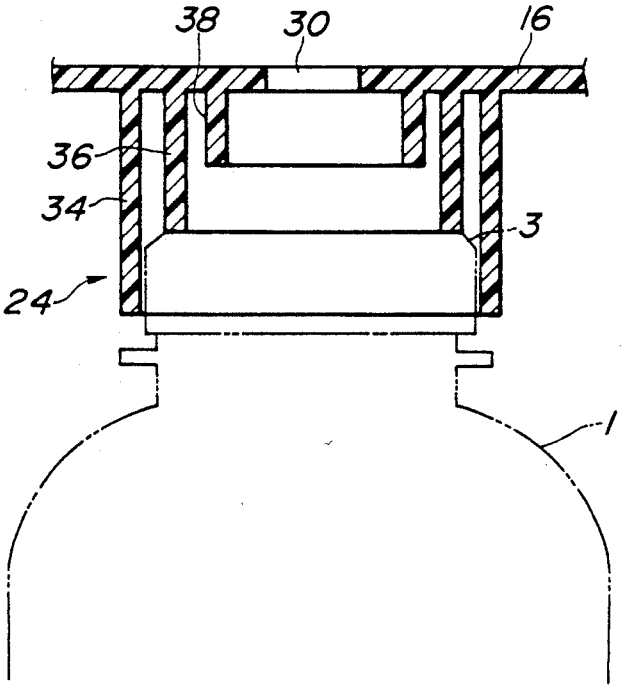
FIG. 7 is a sectional view showing a cap socket according to a second embodiment of the invention.

It is to be understood that the present invention is not limited to the first embodiment described above. Referring now to FIG. 7, there is shown a second embodiment of the invention. In this second embodiment, each cap socket 24 is defined by three coaxial peripheral walls 34, 36 and 38. In this case, the cap socket 24 is applicable to three types of bottles 1 with different outside diameters of the caps 3.

Figure 8:
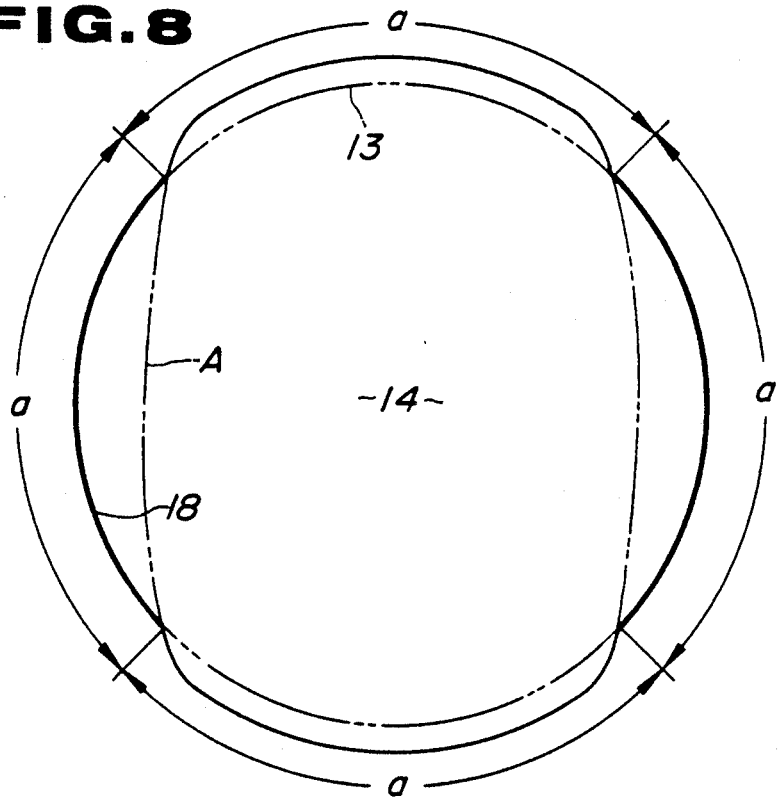
FIG. 8 is a plan view showing a bottom socket according to a third embodiment of the invention.

Referring now to FIG. 8, there is shown a third embodiment of the present invention. In this third embodiment, the configuration of each bottom socket 14 is obtained by connecting two portions a of the contour of an ellipse A and two portions b of the contour of a circle B. In this case, when the bottom portion of a bottle 1 is inserted into the bottom socket 14, the bottom portion is supported by two regions of a peripheral wall 18 of the socket 14. Guide ribs 22 are not shown in FIG. 8.

The cross-sectional configuration of each bottle 1, which defines the configuration of each bottom socket 14, is not limited to the aforementioned combinations of the ellipse A, circle B, and square C. For example, the ellipse A shown in FIG. 4. may be replaced with an ellipse D whose regions d bulge more than those of the ellipse A so that they are in line with the contours of their corresponding corner portions of the square C, as indicated by dashed lines in FIG. 4. In this case, the configuration of the bottom socket 14 is obtained by connecting regions d', b, and c.

What is claimed is:

1. A tray for holding a forest of bottles each having a cap fitted on the mouth portion thereof, comprising:

a tray body having upper and lower surfaces;

means for distributively defining, in the upper surface of the tray body, a number of bottom sockets in which the respective bottom portions of the bottles are to be inserted, each of said bottom sockets having a peripheral configuration obtained by connecting those portions of the respective cross-sectional contours of the bottom portions of at least two different types of bottles which project outwardly of the other concentrically superposed contours when the individual contours are superposed concentrically, so that at least two diametrically facing regions of one contour are not situated inside another contour; and means for idstributively defining, in the lower surface of the body, cap sockets in which the caps of the bottles are to be inserted, said cap sockets bein as many in number as the bottom sockets and each cap socket is located coaxially with the bottom socket corresponding thereto.

2. A tray according to claim 1, which further comprises centering means for aligning the axis of each said bottle with the axis of one of the bottom sockets when the bottle is inserted in the bottom socket.

3. A tray according to claim 2, wherein said centering means includes a plurality of guide ribs arranged circumferentially at intervals on the peripheral edge portion of a bottom wall of the bottom socket, each said guide rib having a slanting surface declining from an inner peripheral wall of the bottom socket to the bottom wall and adapted to bear the bottom of the bottle.

4. A tray according to claim 1, wherein said means for defining the cap sockets includes forming means for forming each said cap socket into a stepped hole whose diameter is incrementally reduced in stages with distance from the open end thereof.

5. A tray according to claim 4, wherein said forming means includes a circular first peripheral wall protruding from the lower surface of the body and second peripheral walls arranged coaxially inside and/or outside the first peripheral wall in a spaced manner.

6. A tray as set forth in claim 1, wherein said upper surface of said tray body defines a plurality of formed recesses each for receiving a base of a bottle, said lower surface of said tray body defining a plurality of bottle cap sockets each for receiving a cap of a bottle fixed in a recess in a next adjacent lower tray and located about coaxially with the axis of said bottle so that said trays with bottles therein can be stacked one atop another, each of said cap sockets being defined by an outer peripheral wall projecting from the lower surface of said tray to a first length and at least one inner peripheral wall located coaxially with and within said outer peripheral wall and projecting from the lower surface of said tray to a second length less than said first length, thereby defining a stepped opening for receiving caps of at least two different dimensions.

7. The tray as set forth in clai and said inner peripheral walls are circular in cross-section thus defining an outer larger diameter and an inner smaller diameter which are related to the outside diameters of different bottles.

8. The tray as set forth in claim 6 further including at least one intermediate peripheral wall located intermediate said inner and said outer peripheral walls, and projecting from the lower surface of said tray a distance greater than that of the inner peripheral wall and less than that of the outer peripheral wall.

9. The tray as set forth in claim 8 wherein said intermediate peripheral wall is circular in cross-section whereby the cap socked can accommodate caps of at least three different diameters.

10. A tray for holding a plurality of bottles in a generally vertical orientation along a generally vertical elongated axis of each bottle, comprising:

a tray body having an upper surface and a lower surface, said upper surface defining a plurality of formed recesses each for receiving a base of a bottle, said bottom surface defining a plurality of bottle cap sockets each for receiving a cap of a bottle fixed in a recess of a next adjacent lower tray and located about coaxially with the axis of said bottle so that said trays with bottles therein can be stacked one atop another, each of said formecd recesses in said upper surface being defined by a bottom wall constituting part of the tray bòdy and a peripheral wall integrally rising from the bottom wall, the upper peripheral edge of the peripheral wall defining each bottom socket, said bottom sockets being structural adapted to receive at least two kinds of bottles having bottom portions with different circumferential contours, the contour of said bottom recess being obtained by connecting the outermost portions of the respective contours of at least two geometrical shapes superimposed concentrically, said contour being formed by the outermost contours of the superimposed concentrically arranged contours; and wherein said geometrical shapes are an ellipse, a circle, and a square superposed concentrically, wherein the major and minor axes of the ellipse are longer and shorter respectively than the diameter of the circle so that the portions of the contour of the ellipse which are situated corresponding to the opposite ends of the major axes project outward from the contour of the circle, a diagonal of the square being longer than the major axis of the ellipse so that when the square is superimposed concentrically on the circle and the ellipse, one of the diagonals of the square is in line with the major axis of the ellipse and the four corner portions of the square project from the contours of the circle and the ellipse, four portions of a contour of the ellipse projecting outwardly from the contours of the circle and the square, four portions of the contour of the square projecting outwardly from the contour of the circle and the ellipse, and four portions of the contours of the circle projecting outwardly from the contours of the ellipse and the square, the respectively outwardly projecting four portions of the geometrical figures defining the peripheral wall of the bottom socket.

11. A tray for holding a plurality of bottles in a generally vertical orientation along a generally vertical elongated axis of each bottle, comprising:

a tray body having an upper surface and a lower surface, said upper surface defining a plurality of formed recesses each for receiving a base of a bottle, said bottom surface defining a plurality of bottle cap sockets each for receiving a cap of a bottle fixed in a recess of a next adjacent lower tray and located about coaxially with the axis of said bottle so that said trays with bottles therein can be stacked one atop another, each of said formed recesses in said upper surface being defined by a bottom wall constituting part of the tray body and a peripheral wall integrally rising from the bottom wall, the upper peripheral edge of the peripheral wall defining each bottom socket, said bottom sockets being structural adapted to receive at least two kinds of bottles having bottom portions with different circumferential contours, the contour of said bottom recess being obtained by connecting the outermost portions of the respective contours of at least two geometerical shapes superimposed concentrically, said contour being formed by the outermost contours of the superimposed concentrically arranged contours; and wherein the configuration of each bottom socket is obtained by connecting two portions of the contour of an ellipse and two portions of the contour of a circle, said peripheral wall being arranged so that when the bottom portion of a bottle is inserted into the bottom socket, the bottom portion is supported by two regions of a peripheral wall of the socket.

* * * * *